US009297602B2

(12) United States Patent
Marcotte

(10) Patent No.: US 9,297,602 B2
(45) Date of Patent: Mar. 29, 2016

(54) FIREARM BUMP STOCK ASSEMBLY

(71) Applicant: Bryant A. Marcotte, Washington, LA (US)

(72) Inventor: Bryant A. Marcotte, Washington, LA (US)

( * ) Notice: Subject to any disclaimer, the term of this patent is extended or adjusted under 35 U.S.C. 154(b) by 0 days.

(21) Appl. No.: 14/566,257

(22) Filed: Dec. 10, 2014

(65) Prior Publication Data

US 2015/0308785 A1 Oct. 29, 2015

Related U.S. Application Data

(60) Provisional application No. 61/914,083, filed on Dec. 10, 2013.

(51) Int. Cl.
*F41F 1/00* (2006.01)
*F41A 25/00* (2006.01)
*F41A 23/16* (2006.01)

(52) U.S. Cl.
CPC ..... *F41A 25/00* (2013.01); *F41A 23/16* (2013.01)

(58) Field of Classification Search
USPC ..... 89/132, 139, 37.13, 27.3, 37.04; 42/90, 42/94
See application file for complete search history.

(56) References Cited

U.S. PATENT DOCUMENTS 7,273,002 B1 * 9/2007 Rogers ..... F41A 19/09 89/142
8,459,171 B2 * 6/2013 Cottle ..... F41A 19/06 42/94

* cited by examiner

*Primary Examiner* — J. Woodrow Eldred
(74) *Attorney, Agent, or Firm* — Ted M. Anthony

(57) ABSTRACT

A firearm bump stock assembly provides a mount and support for a conventional semi-automatic firearm. The firearm bump stock assembly beneficially provides a user with the ability to increase the fire rate efficiency of a firearm by reducing the amount of time between pulling of a trigger on a firearm and reloading of a new bullet into a chamber of said firearm, thus allowing said firearm to be reloaded and fired more rapidly. The firearm bump stock assembly also beneficially provides a user with the ability to maintain accuracy of said firearm and to easily aim and maneuver said firearm, while concurrently being able to increase said firearm's rate of fire.

10 Claims, 13 Drawing Sheets

FIREARM BUMP STOCK ASSEMBLY

CROSS REFERENCES TO RELATED APPLICATION

Priority of U.S. Provisional Patent Application Ser. No. 61/914,083, filed Dec. 10, 2013, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a "bump-fire" assembly designed for attaching to a firearm(s), including, but not limited to, semi-automatic rifles. The assembly of the present invention can be used to mount and support a conventional semi-automatic firearm. More particularly, the present invention pertains to an assembly for increasing fire rate efficiency of a firearm by reducing an amount of time between pulling of a trigger on a firearm and reloading of a new bullet into a chamber of said firearm, thereby allowing said firearm to be reloaded, and ultimately, fired more quickly.

2. Brief Description of the Prior Art

"Bump-firing" utilized recoil of a semi-automatic firearm is used to fire multiple shots in rapid succession, thereby simulating a discharge of a fully automatic firearm. With a conventional bump fire system, a firearm foregrip is held with a user's non-trigger hand; the firearm is pushed forward in order to apply pressure on a stationary trigger finger. During a shot, the firearm will recoil (or "bump" in a relatively backward direction toward the user) and the trigger will reset itself. Thereafter, the user's non-trigger hand forces the firearm back to the relative original position, forcing said trigger against the stationary finger in order to fire another shot in quick succession.

Consequently, conventional bump fire systems have a significant negative impact on a user's ability to aim a firearm, and thus, the accuracy of said firearm, due to a necessary jerking motion of said firearm.

Thus, there is a need for a bump fire system that allows for a rapid increase in a firearm's rate of fire, while concurrently maintaining accuracy of aiming the firearm and accuracy of the firearm's shot.

SUMMARY OF THE INVENTION

The present invention comprises a firearm bump-stock assembly that can increase fire rate efficiency of a firearm by being able to reduce an amount of time between pulling of a trigger on a firearm and reloading of a new bullet into a chamber of said firearm, thereby allowing said firearm to reload, and ultimately, fire more quickly, while maintaining accuracy of said firearm.

In a preferred embodiment, the bump stock assembly of the present invention can be used to mount and support a conventional semi-automatic firearm, and thus, is compatible with a variety of types of semi-automatic firearms, including, but not limited to firearms comprising a picatinny rail or a tactical rail underneath a hand guard, or firearms comprising an AR-type buffer tube. Ultimately, the bump stock assembly of the present invention is more reliable than conventional bump fire systems and is beneficial to any user that has difficulty in supporting and holding a firearm, such as, for example, a user who is disabled or a user who lacks strength capabilities.

In a preferred embodiment, the bump stock assembly of the present invention comprises a receiving assembly that can hold and support a firearm having desired properties. Said receiving assembly can be removably attached to a supporting member which, in turn, is connected to a firearm mount frame.

In a preferred embodiment, said firearm mount frame attachably affixes to a body of a firearm, thus stabilizing said firearm, and ultimately, maintaining accuracy and aim of said firearm. Said firearm mount frame is joined and affixed to a stand assembly, thereby further holding and securing said firearm when said firearm is in use.

In a preferred embodiment, said bump stock assembly of the present invention allows a user to apply a consistent amount of forward pressure to a rear end of a buffer tube, thereby causing the firearm to slide forward, and thus, causing a trigger to be actuated by compressing against a stationary rigid member, such as, for example, a cross-bolt, or any other similar rigid member having desired characteristics. Said cross-bolt connecting through said trigger guard allows said firearm to be able to discharge, as said firearm is pressed forward and said trigger is compressed against said cross-bolt. Then, said firearm's discharge recoils said firearm in a backwards motion, thereby allowing the trigger to reset, and thus, fire again from said forward consistent pressure that is caused by the user's thumbs and/or hands and the constant contact of the trigger with the cross-bolt. This results in a simulation of a fully automatic discharge from a semi-automatic firearm.

Thus, as a result, the bump stock assembly of the present invention allows a user to be able to increase a firearm's rate of fire, while simultaneously allowing said user to maintain accuracy of said firearm.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
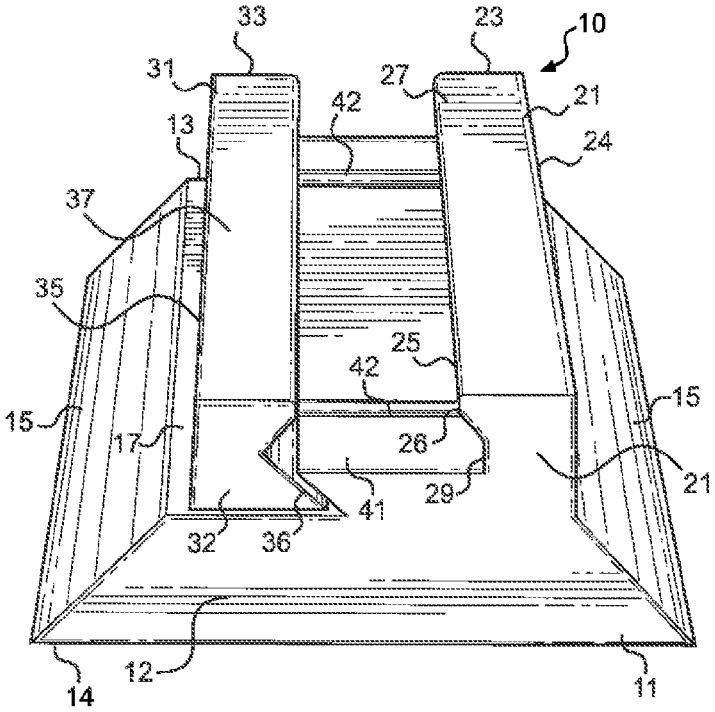
FIG. 1 depicts a front perspective view of a preferred embodiment of a receiving assembly of the present invention in a connected configuration.
Figure 3:
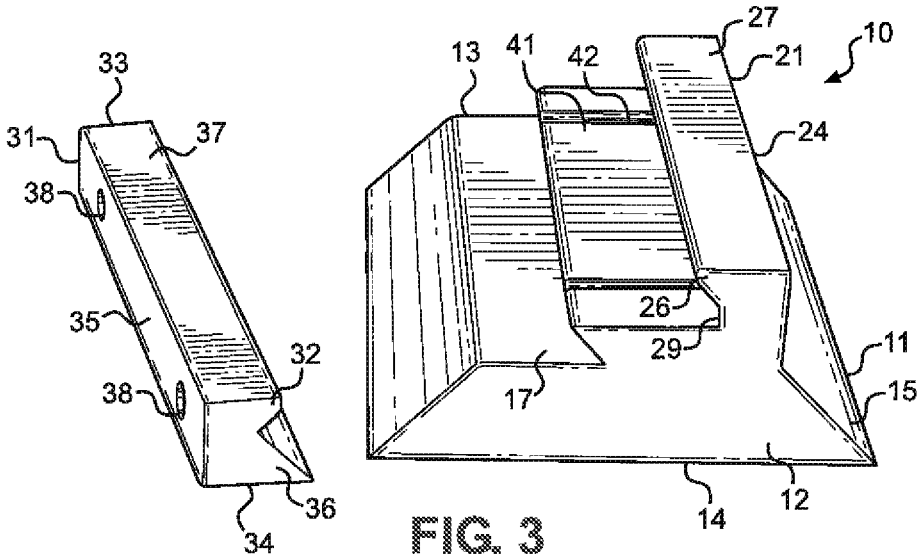
FIG. 3 depicts a front perspective view of a preferred embodiment of a receiving assembly of the present invention in an exploded or disconnected configuration.

Referring to the drawings, FIG. 1 depicts a front perspective view of a preferred embodiment of a firearm receiving assembly 10 of the present invention in a connected configuration, while FIG. 3 depicts a front perspective view of a preferred embodiment of a firearm receiving assembly 10 of the present invention in an exploded or disconnected configuration.

FIG. 1 depicts a front perspective view of a firearm receiving assembly 10 of the present invention generally comprising receiver member 11 and receiver attachment member 31 in a connected configuration. As depicted in FIG. 1, receiver member 11 and receiver attachment member 31 can be manufactured from a solid structural material, such as, for example, a metal material, or any other substantially solid material exhibiting desired characteristics.

In a preferred embodiment, receiver member 11 generally comprises a substantially trapezoidal-shaped configuration having a front end 12 and a rear end 13. Receiver member 11 further comprises a substantially horizontal base member 14 and substantially slanted side members 15; side members 15 slant in a relatively inward direction towards a mid-point of said receiver member 11, thereby causing said receiver member 11 to taper in a relatively inward direction. A top 17 of said receiver member 11 comprises a substantially horizontal surface that is formed off of an edge of one side member 15 and extends in a horizontal manner until a relative mid-point of said receiver member 11, thereby creating a flat or planar surface that is oriented in a substantially parallel configuration to said base member 14.

Still referring to FIG. 1, receiver member 11 further beneficially comprises an extension 21 that extends in a relatively upward and perpendicular orientation to said top member 17. Extension 21 generally comprises an outer surface 24, an inner surface 25, and a top surface 27 that cooperate to form a rigid rail-like configuration with a front surface 22 and a rear surface 23. Inner surface 25 forms extension recess 29 having extension flange or shoulder 26.

Receiver attachment member 31 comprises a substantially horizontal base member 34, substantially horizontal top member 37, substantially vertical side member 35, and substantially angled side member 36 that cooperate to form a rigid beam-like configuration with a front surface 32 and a rear surface 33. Base member 34 of receiver attachment member 31 directly aligns and corresponds with top member 17 of receiver member 11 and angled side member 36 of receiver attachment member 31 can be received and fits within extension 21, thereby allowing receiver attachment member 31, when joined to receiver member 11, to cooperate with said receiver member 11 and form a cohesive unit. In such a configuration, receiver member 11 and receiver attachment member 31 cooperate to form a channel or trough 41 between receiver attachment member 31 and extension member 21. Said channel 41 extends along a length of said receiving assembly 10 and comprises a plurality of inner notches 42. Said plurality of inner notches 42 axially extend across said channel 41 in a perpendicular manner to the longitudinal axis of said channel 41.

Although not depicted in FIG. 1, said notches 42 directly align and connect to a plurality of bores 28 that are positioned along an outer surface 24 of said extension 21 and a plurality of bores 38 that are positioned along an outer surface of vertical side 35 of said receiver attachment member 31.

Figure 2:
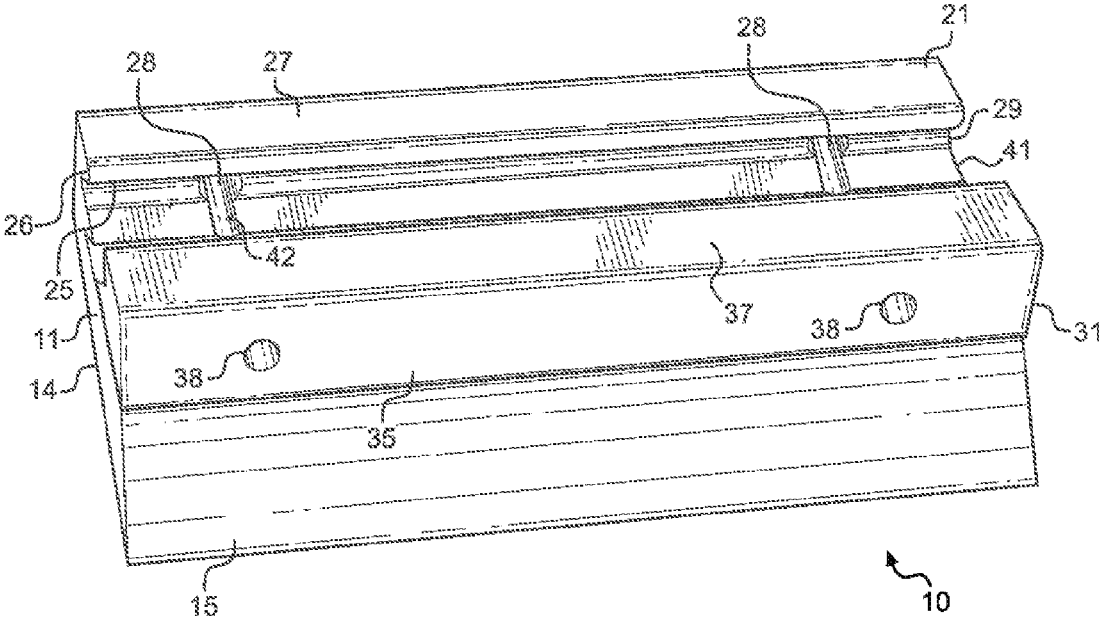
FIG. 2 depicts a side perspective view of a preferred embodiment of a receiving assembly of the present invention in a connected configuration.

FIG. 2 depicts a side perspective view of firearm receiving assembly 10 of the present invention generally comprising receiver member 11 and receiver attachment member 31 in a connected configuration. As illustrated in FIG. 2, extension member 21 comprises a plurality of bores 28 that are positioned along an outer side surface 24 of said extension member 21 and extend into said channel 41. Moreover, receiver attachment member 31 comprises a plurality of bores 38 that are positioned along an outer surface 35 of said receiver attachment member 31 and extend into said channel 41. Notches 42 axially extend along a surface of said channel 41 from receiver attachment member bores 38 to extension member bores 28, thereby aligning said bores 38 and 28.

Although not depicted in FIG. 2, said receiving assembly 10 is beneficially connected to a bottom of a hand guard of a firearm and is used to secure said firearm to said bump stock assembly of the present invention. A plurality of bolts 48 (constructed of a rigid material having sufficient strength such as, for example, steel, brass, or any other like material) extend through aligned bores 38 and 28 in receiver attachment member 31 and extension member 21, and thus, through said notches or troughs 42. Threaded nuts 49 are then threadedly connected to bolts 48 and impart compressive forces to said extension member 21 and said receiver attachment member 31. As such, this allows for a secure connection between said receiving assembly 10 and said hand guard of said firearm.

FIG. 3 depicts a front perspective view of a receiving assembly 10 of the present invention comprising receiver member 11 and receiver attachment member 31 in a disconnected configuration. As illustrated in FIG. 3, receiver attachment member 31 comprises a plurality of bores 38 that are positioned along an outer side surface 35 of said receiver attachment member 31 and extend into said channel 41. In a preferred embodiment, a firearm can be placed within said channel 41 when receiver member 11 and receiver attachment member 31 are disconnected. After said firearm is aligned with said channel 41 of receiving assembly 10, receiver attachment member 31 is then attachably connected to said receiver member 11, and thus, said firearm via bolts 48 and threaded nuts 49, thereby creating a secure and stable means of connection.

Figure 4:
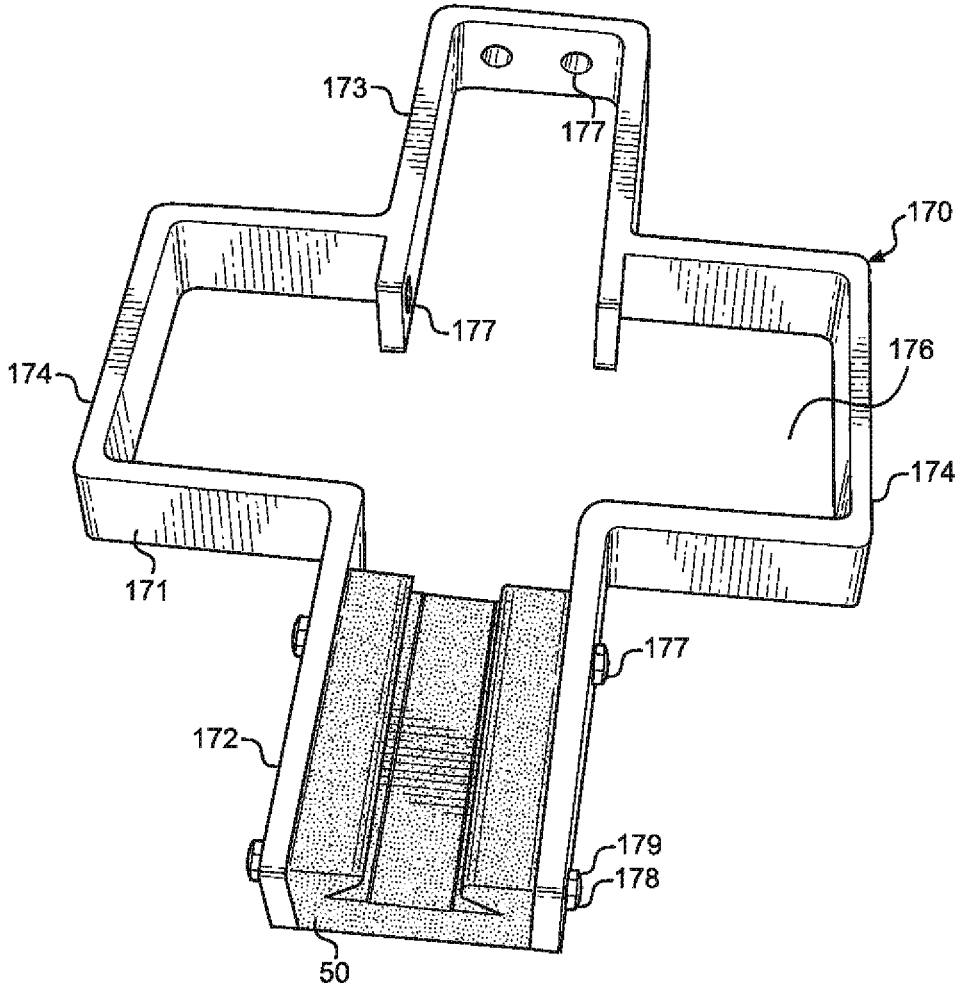
FIG. 4 depicts an overhead perspective view of an alternate embodiment of a firearm mount frame and a supporting member of the present invention in an attached configuration.

FIG. 4 depicts an overhead perspective view of an alternate embodiment of a firearm mount frame 170 of the present invention detachably connected to a supporting track member 50 of the present invention. As depicted in FIG. 4, firearm mount frame 170 comprises a plurality of structural members or panels 171 that are connected via being welded, molded, or via other similar and secure attachment means. Moreover, said firearm mount frame 170 further comprises a rigid (typically a metal material) frame in order to tightly affix joined components to said frame. In an alternate embodiment, the plurality of panels 171 of firearm mount frame 170 generally comprise a front end 172, a rear end 173, and sides 174 that cooperate to form a substantially cross-shaped configuration defining an inner orifice-like space or opening 176.

Firearm mount frame 170 generally comprises a plurality of bores 177 positioned along said front end 172 and said rear end 173 of said firearm mount frame 170 and that extend through said frame and into said inner opening 176. Said plurality of bores 177 beneficially provide a means of connection with other components in said bump stock assembly. In this manner, as depicted in FIG. 4, a supporting member 50 can be received within an inner opening 176 of firearm mount frame 170 and can directly align and correspond with a front end 172 of said firearm mount frame 170. Supporting member 50 can be jointly affixed to said firearm mount frame 170 via a plurality of bolts 178 and threaded nuts 179 extending through said bores 177, thereby connecting to an outer surface 54 of said supporting member 50.

Figure 5:
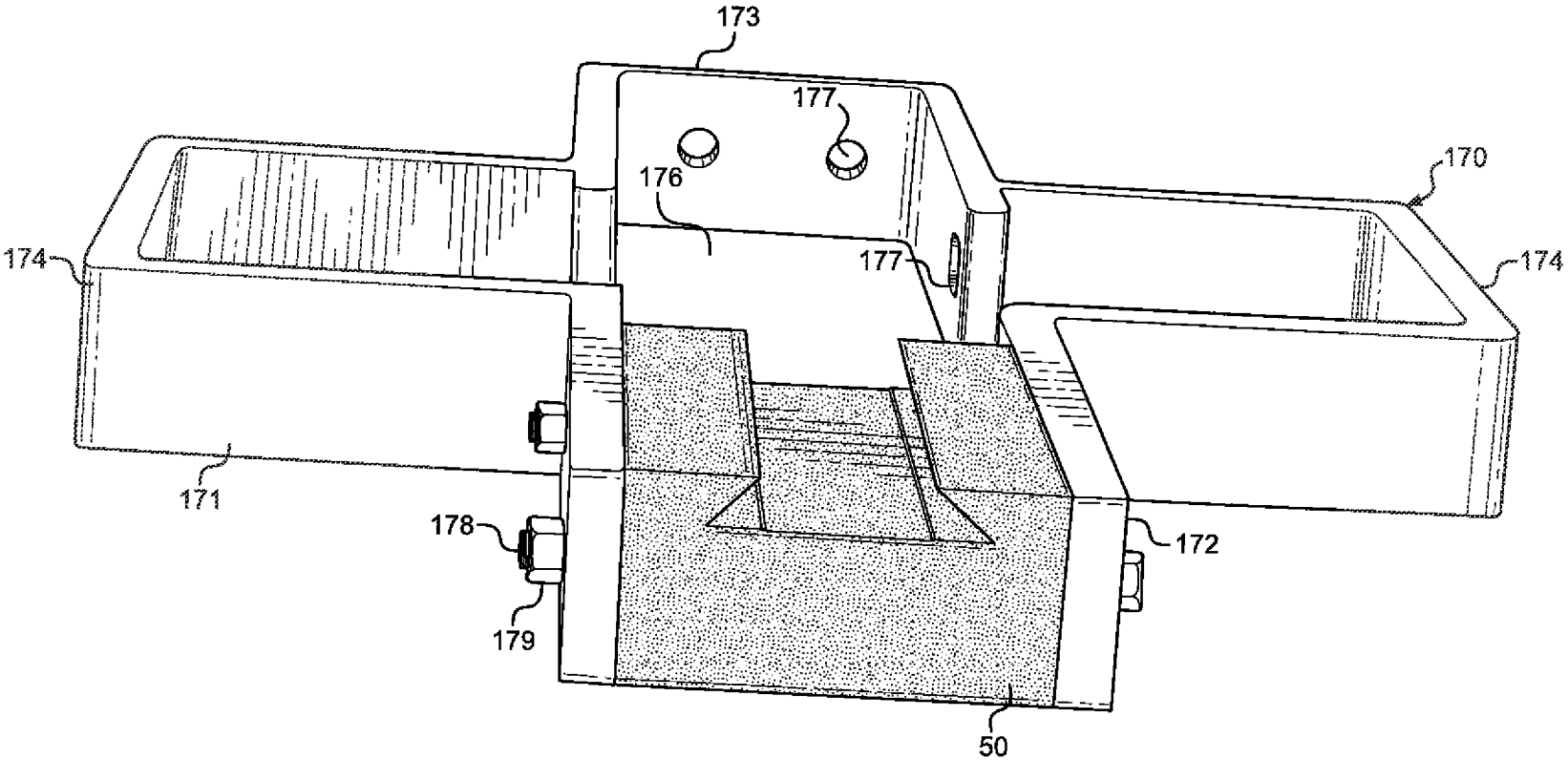
FIG. 5 depicts a front perspective view of an alternate embodiment of a firearm mount frame and a supporting member of the present invention in an attached configuration.

FIG. 5 depicts a front perspective view of a firearm mount frame 170 of the present invention detachably connected to a supporting member 50 of the present invention. Supporting track member 50 is received within firearm mount frame 170 at front end 172 of said firearm mount frame 170, thereby enclosing the inner opening 176 of firearm mount frame 170. A plurality of bores 177 of said front end 172 allow for bolts 178 to extend through said bores 177, thereby connecting and attaching to said supporting member 50, and thus, securely affixing supporting member 50 to firearm mount frame 170.

Figure 6:
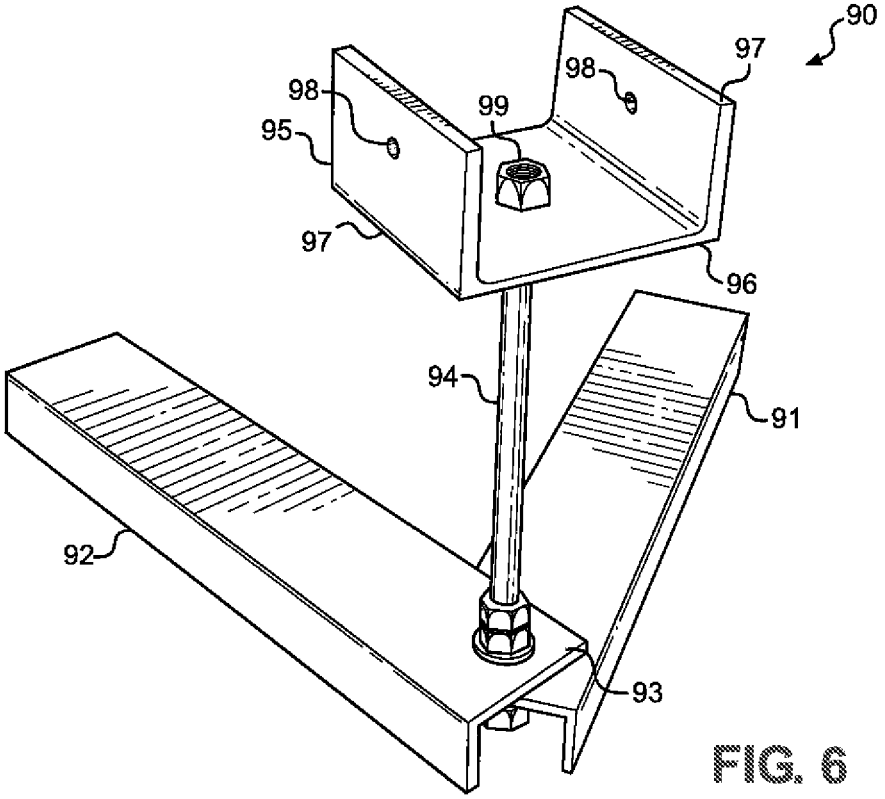
FIG. 6 depicts a front perspective view of a preferred embodiment of a stand member of the present invention.

FIG. 6 depicts a front perspective view of a preferred embodiment of a firearm stand assembly 90 of the present invention generally comprising a base member 91, a rod-like shaft extension member 94, and a housing member 95. It is to be observed that stand assembly 90 can be manufactured from a solid structural material, such as, for example, a metal material, or any other substantially solid material exhibiting desired characteristics. As depicted in FIG. 6, base member 91 comprises a substantially "V" shaped support 92 that allows the bump stock assembly of the present invention to maintain proper stability while a firearm is firing. Moreover, shaft extension 94 is mounted to an apex 93 of "V" shaped base member 91 and is oriented in a substantially perpendicular position from base member 91, thus, extending in a relatively upward direction from base member 91.

Housing member 95 of stand assembly 90 is mounted to shaft extension 94 via bolt(s), welding, or other secure attachment means. Housing member 95 comprises a substantially planar base 96 and substantially planar sides 97 that extend in a relatively upward direction from said base 96. Said sides 97 are oriented substantially parallel to each other, while oriented substantially perpendicular to said base 96, thereby cooperating to form a partially enclosed shelf that beneficially holds and mounts said firearm. Said sides 97 further comprise circular bores 98 that correspond to said bores 77, 57 of said firearm mount frame 70 and said supporting member 50, respectively, in a generally aligning orientation, thus allowing for a means of connection between firearm mount frame 70, supporting member 50, and stand assembly 90.

Figure 7:
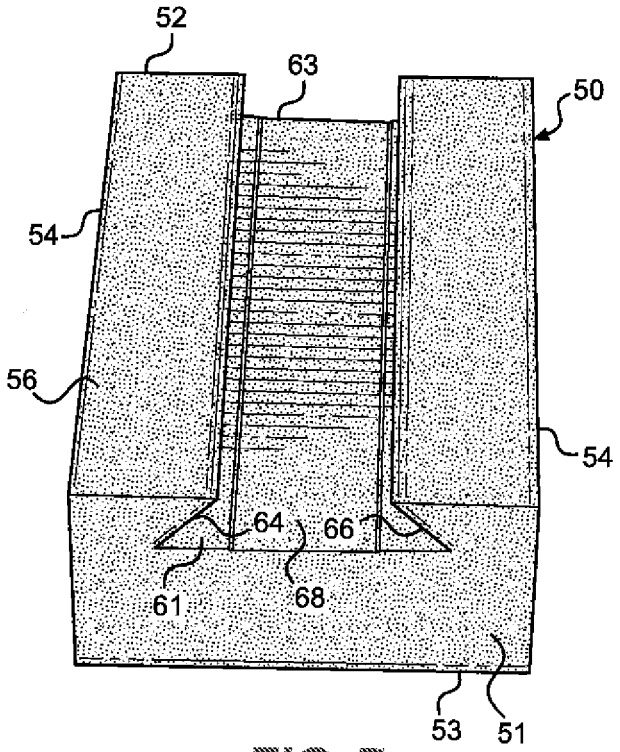
FIG. 7 depicts a front perspective view of a preferred embodiment of a supporting member of the present invention.

FIG. 7 depicts a front perspective view of a preferred embodiment of a supporting track member 50 of the present invention. As illustrated in FIG. 7, supporting track member 50 can be manufactured from a solid structural material, such as, for example, a metal material, or any other substantially strong material exhibiting desired characteristics. In a preferred embodiment, supporting track member 50 generally comprises a block-like configuration, with a substantially horizontal base 53, substantially horizontal top 56, substantially vertical sides 54, and a front end surface 51 and a rear end surface 52. Said base 53 and said top 56 are oriented substantially parallel to each other, while said sides 54 are oriented substantially parallel to each other; base 53, top 56, and sides 54 cooperate to form a rectangular structure. Additionally, said top 56 comprises a channel or indention 61 that extends from a front surface 51 of said supporting member 50 to a rear surface 52 along the longitudinal axis of said supporting track member 50.

In a preferred embodiment, supporting member channel 61 generally comprises a relatively similarly shaped configuration as the base of assembled receiving assembly 10, thereby permitting said receiving assembly 10 to be received within supporting member channel 61 and to complementarily align and mate with supporting member 50.

Said channel 61 further comprises a horizontal base 63 and angled sides 64 that cooperate to form a shoulder 66 on each side 64 of supporting member channel 61. In addition, base 63 of said channel 61 comprises an indentation 68 that extends from the front end surface 51 to the rear end surface 52 of supporting member 50. Said indentation 68 beneficially reduces the amount of surface area that receiving assembly 10 contacts, thus reducing the amount of drag or frictional force that is created when receiving assembly 10 slidably extends along supporting track member 50 as the bump stock assembly of the present invention is in use. Less frictional forces his result in relatively quicker movement of receiving assembly 10 along supporting track member 50, and ultimately, a firearm as said firearm is being discharged.

Although not visible in FIG. 7, supporting track member 50 further comprises a plurality of circular bores 57 that are beneficially positioned along sides 54 of said supporting track member 50 extending through said sides 54 and creating a passage into said supporting track member 50. Additionally, although not visible in FIG. 7, a bore 57 on each side 54 of said supporting member 50 beneficially corresponds to the bores 98 of said housing member 95 of said stand 90 in a generally aligning orientation, thus allowing for a means of connection between supporting track member 50 and stand assembly 90. Further, remaining bores 57 on sides 54 of said supporting track member 50 beneficially correspond to bores 77 of said firearm mount frame 70, thus allowing for a means of connection between supporting track member 50 and firearm mount frame 70.

Figure 8:
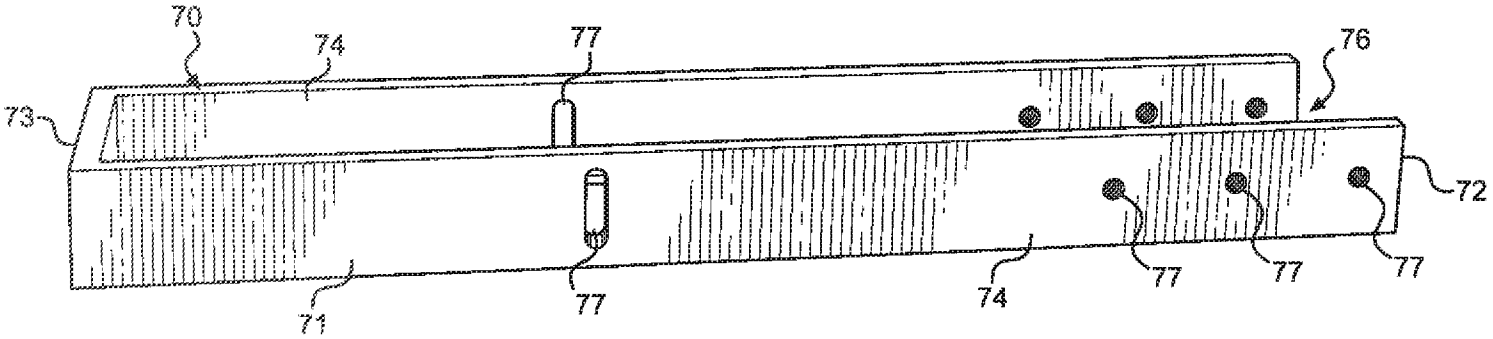
FIG. 8 depicts a side perspective view of a preferred embodiment of a firearm mount frame of the present invention.

FIG. 8 depicts a side perspective view of a preferred embodiment of an alternative embodiment firearm mount frame 70 of the present invention. As illustrated in FIG. 8, firearm mount frame 70 comprises a plurality of panels 71 that are connected via being welded, molded, or via other similar and secure attachment means. Moreover, said firearm mount frame 70 further comprises a rigid (typically a metal material) frame in order to tightly affix joined components to said frame 70. In a preferred embodiment, the plurality of panels 71 of firearm mount frame 70 generally comprise side members 74 and a rear end member 73 that cooperate to form an elongate rectangular frame defining an inner opening or orifice-like space 76.

Firearm mount frame 70 generally comprises a plurality of bores 77 that are positioned along both sides 74 of firearm mount frame 70 and rear end 73 of firearm mount frame 70, and thus, extend into said inner opening 76. Plurality of bores 77 that are positioned along said side members 74 near a front end 72 of firearm mount frame 70 allow said firearm mount frame 70 to connect to both supporting member 50 and stand assembly 90.

Plurality of bores 77 that are positioned along said side members 74 near a substantial mid-point of side members 74 allow a trigger guard of a firearm (not depicted in FIG. 8) to attachably connect or bolt within said inner opening 76 between said side members 74 via a cross-bolt 75, or any other similar connection means, of said firearm mount frame 70, and thus, lock a firearm into position within said firearm mount frame. Ultimately, said bolt in between side members 74, or a cross-bolt 75, beneficially creates a point of contact for a firearm trigger within a trigger guard, and thus, allows said trigger to compress against said cross-bolt 75, thereby causing said trigger to actuate. It is to be observed that both mounting frames 70 and 170 are described herein; however, said mounting frames represent alternative embodiment frames that can be used in connection with the bump stock assembly of the present invention.

Figure 9:
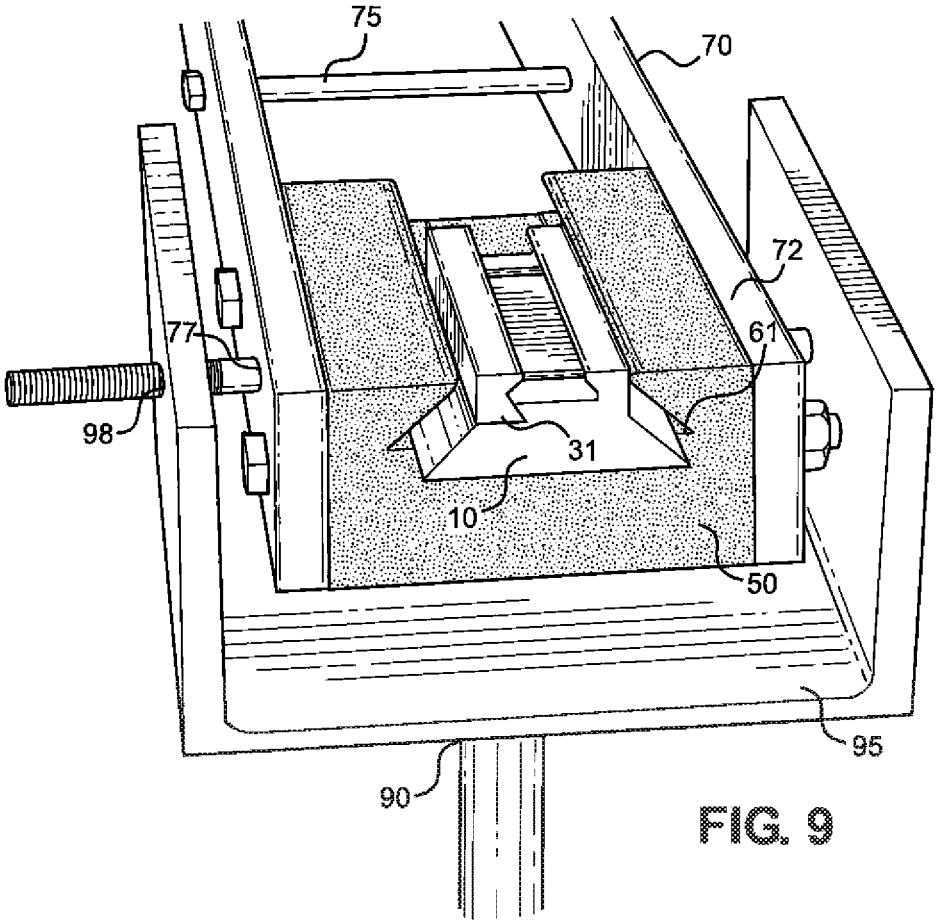
FIG. 9 depicts a front perspective view of a preferred embodiment of a firearm mount frame, a supporting member, and a receiving assembly in an attached configuration and mounted to a stand member of the present invention.

FIG. 9 depicts a front perspective view of a preferred embodiment of a bump stock assembly of the present invention comprising receiver assembly 10, supporting track member 50, firearm mount frame 70, and stand assembly 90. As illustrated in FIG. 9, receiving assembly 10 directly aligns with and is slidably received within channel 61 of supporting track member 50. Receiving assembly 10 axially slides within channel 61 of supporting track member 50, and thus, as bump stock assembly of the present invention is in use and a firearm attached to receiving assembly 10 (as described below) is being pressed in a forward motion, said receiving assembly 10, and ultimately, an attached firearm, axially slide along channel 61.

Moreover, supporting track member 50 directly aligns with and is received within a front end 72 of firearm mount frame 70. Thus, when coupled together, receiving assembly 10 and supporting track member 50 interlock, and ultimately affix to firearm mount frame 70, thereby creating a supporting means for a firearm. In addition, front end 72 of firearm mount frame 70 is received within housing member 95 of stand assembly 90, thereby directly aligning and connecting via housing member bores 98 and firearm mount frame bores 77. This allows a user to conveniently bolt and lock firearm mount frame 70 to stand assembly 90, and ultimately securing a firearm into a steady position.

Figure 10:
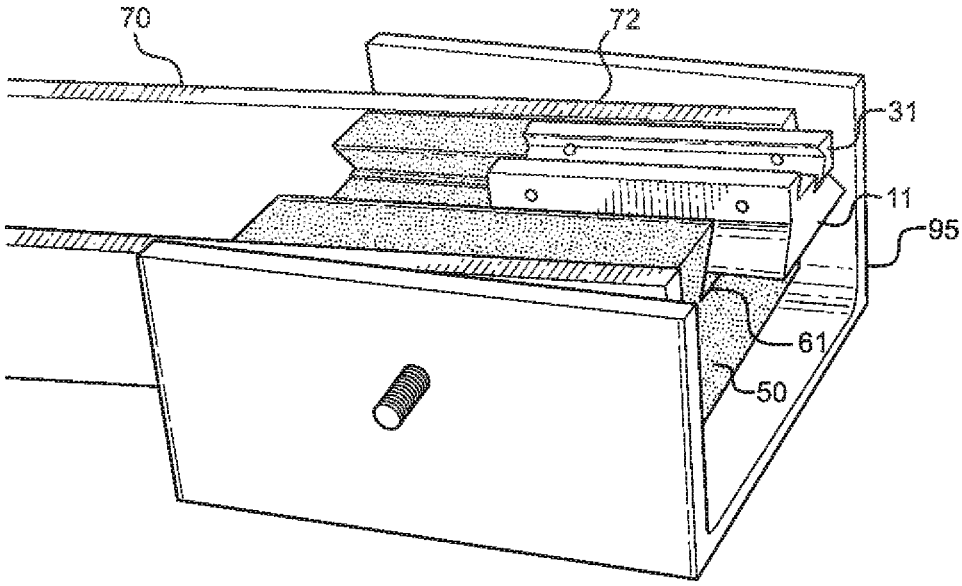
FIG. 10 depicts a side perspective view of a preferred embodiment of a firearm mount frame, a supporting member, and a receiving assembly in an attached configuration and mounted to a stand member of the present invention.

FIG. 10 depicts a side perspective view of a preferred embodiment of a bump stock assembly of the present invention comprising receiving assembly 10, supporting track member 50, firearm mount frame 70, and stand assembly 90. As depicted in FIG. 10, receiving assembly 10 directly aligns with and is received within channel 61 of supporting track member 50. Supporting track member 50 is then received within front end 72 of firearm mount frame 70 and attachably connected via a plurality of bolts 78. Firearm mount frame 70 directly aligns with and is received within housing member 95 of stand assembly 90. When coupled together, receiving assembly 10, supporting track member 50, firearm mount frame 70, and stand assembly 90 interconnect, thereby creating a secure and steady bump stock assembly. Thus, firearm mount frame 70 is beneficially connected to both supporting member 50 and stand assembly 90, and is used to secure said components to each other.

Figure 11:
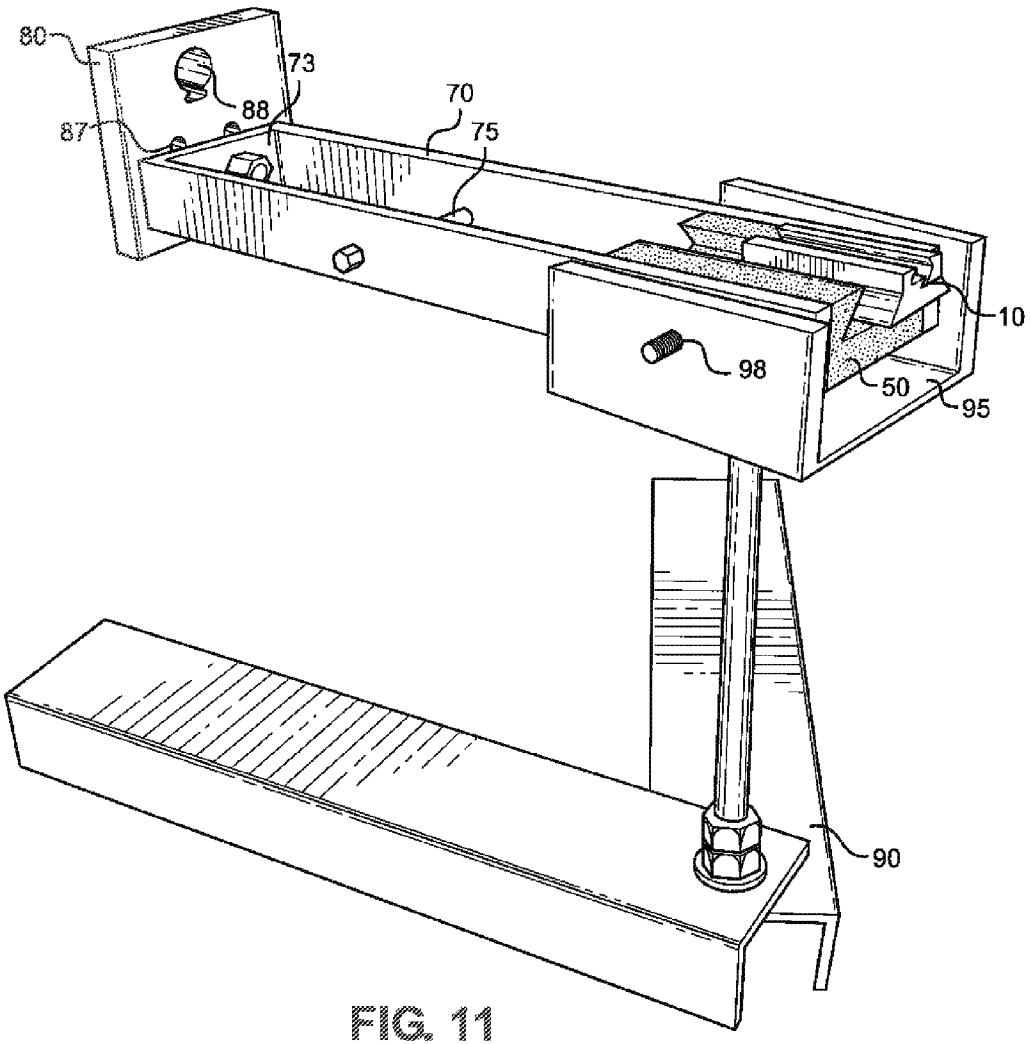
FIG. 11 depicts a side perspective view of a preferred embodiment of a bump stock assembly of the present invention.

FIG. 11 depicts a side perspective view of a preferred embodiment of an assembly bump stock assembly of the present invention generally comprising receiving assembly 10, supporting track member 50, firearm mount frame 70, handle member 80, and stand assembly 90. As illustrated in FIG. 11, a handle member 80 is beneficially connected to rear end 73 of firearm mount frame 70, thus providing a means to aim a firearm mounted within said bump stock assembly.

Figure 12:
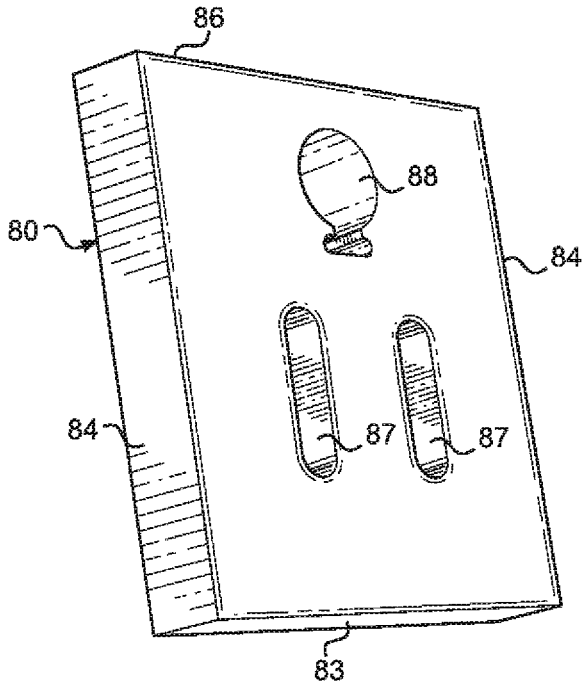
FIG. 12 depicts a side perspective view of a preferred embodiment of a handle member of the present invention.

FIG. 12 depicts a side perspective view of a preferred embodiment of a handle member 80 of the present invention. As illustrated in FIG. 12, handle member 80 can be manufactured from a solid structural material, such as, for example, a wooden material, a metal material, or any other substantially solid material exhibiting desired characteristics. Handle member 80 generally comprises a substantially planar surface with a top 86, a bottom 83, and sides 84 that cooperate to form said handle member 80. As illustrated in FIG. 12, handle member 80 further comprises a plurality of slots 87 that directly align and correspond to plurality of bores 77 on rear end 73 of firearm mount frame 70, thereby allowing for a means of connection between handle 80 and firearm mount frame 70. Moreover, handle 80 comprises a substantially circular bore 88 that receives a buffer tube of a firearm, thereby supporting said firearm while concurrently allowing a user to grip, maneuver and aim said firearm.

Figure 13:
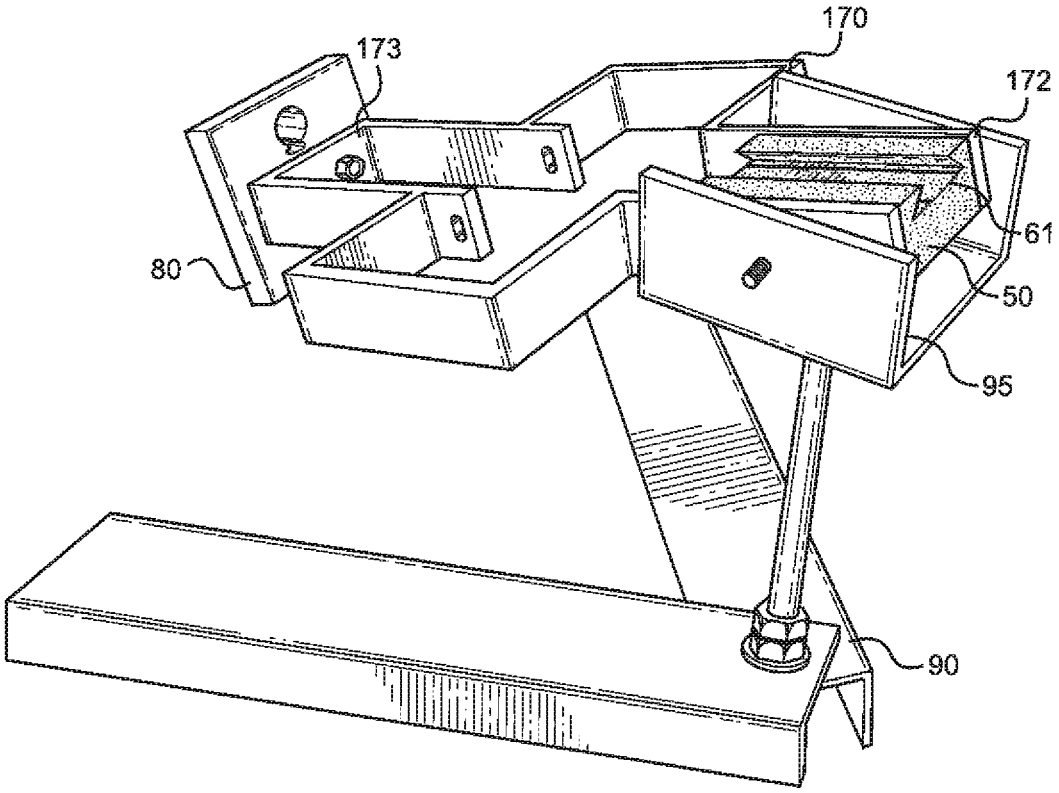
FIG. 13 depicts a side perspective view of an alternate embodiment of a bump stock assembly of the present invention.

FIG. 13 depicts a side perspective view of an alternate embodiment of a bump stock assembly of the present invention generally comprising supporting track member 50, firearm mount frame 170 (in place of firearm mount frame 70, as depicted in FIG. 11), handle member 80, and stand assembly 90. As illustrated in FIG. 13, front end 172 of firearm mount frame 170 is received within housing member 95 of stand assembly 90, while handle 80 is connected to rear end 173 of firearm mount frame 170. Additionally, said firearm mount frame 170 is beneficially connected to both supporting track member 50 and stand assembly 90, and is used to secure said components to each other. Although not depicted in FIG. 13, receiving assembly 10 directly aligns with and can be received within supporting track member 50.

Figure 14:
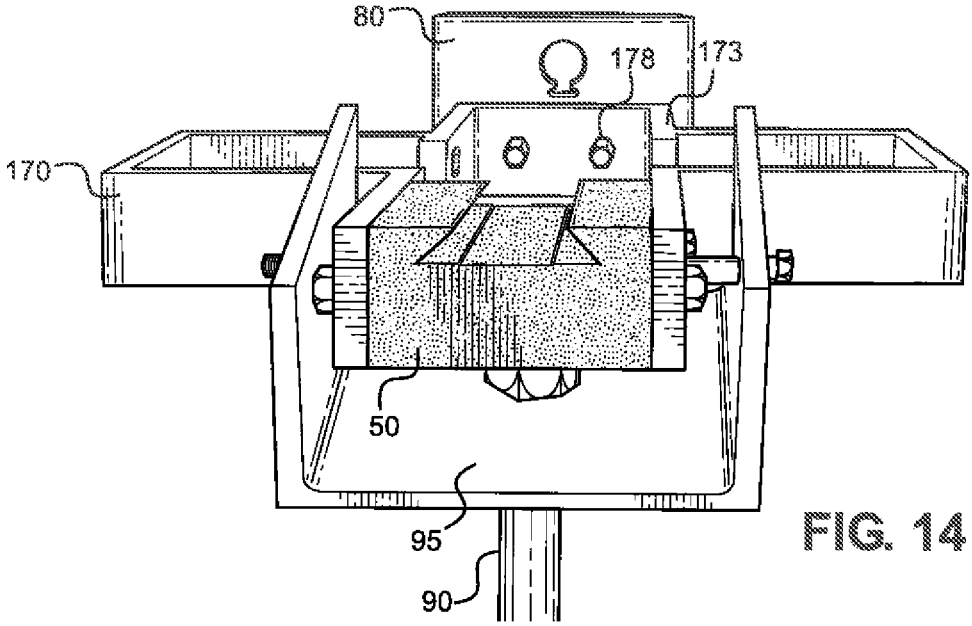
FIG. 14 depicts a front perspective view of an alternate embodiment of a bump stock assembly of the present invention.

FIG. 14 depicts a front perspective view of said alternate embodiment of bump stock assembly of the present invention comprising firearm mount frame 170 with supporting track member 50 installed within housing member 95 of stand assembly 90. Handle member 80 can be attached to rear end 173 of firearm mount frame 170 using bolts 178 or other attachment means.

Figure 15:
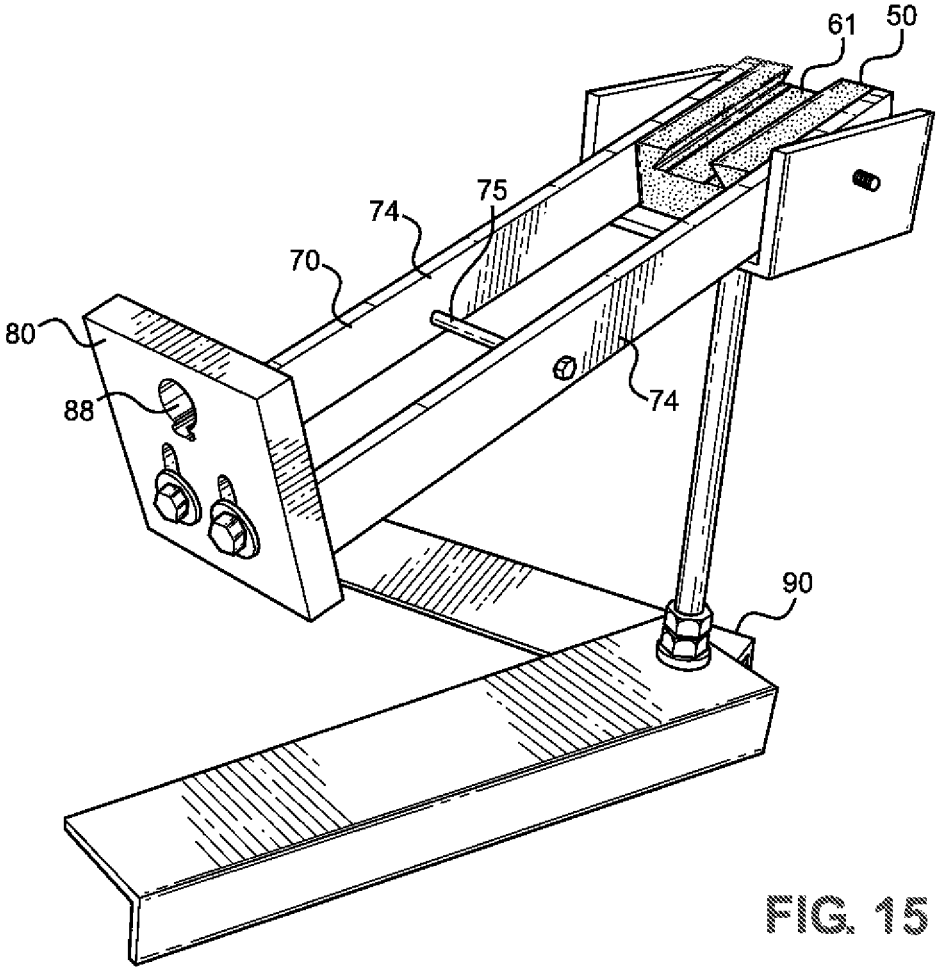
FIG. 15 depicts a rear perspective view of a preferred embodiment of a bump stock assembly of the present invention.

FIG. 15 depicts a rear perspective view of a preferred embodiment of bump stock assembly of the present invention with frame 70 installed. Although not depicted in FIG. 15, in a preferred embodiment, a firearm is placed in a center of said firearm mount frame 70, with a trigger guard of said firearm bolted in between said sides 74 of said firearm mount frame 70 via cross-bolt 75. Then, a hand guard of the firearm is set into place by locking into said receiver member 11 and said receiver attachment member 31 (not shown in FIG. 15), which thereby is slidably received within said channel 61 of said supporting track member 50. A buffer tube of the firearm is then set into place by being supported by circular bore 88 of handle member 80 of the present invention, which is attached to rear end 73 of firearm mount frame 70. As such, firearm mount frame 70 and supporting track member 50 are then bolted to stand assembly 90 of the present invention, thereby allowing firearm and bump stock assembly of the present invention to be properly supported.

Figure 16:
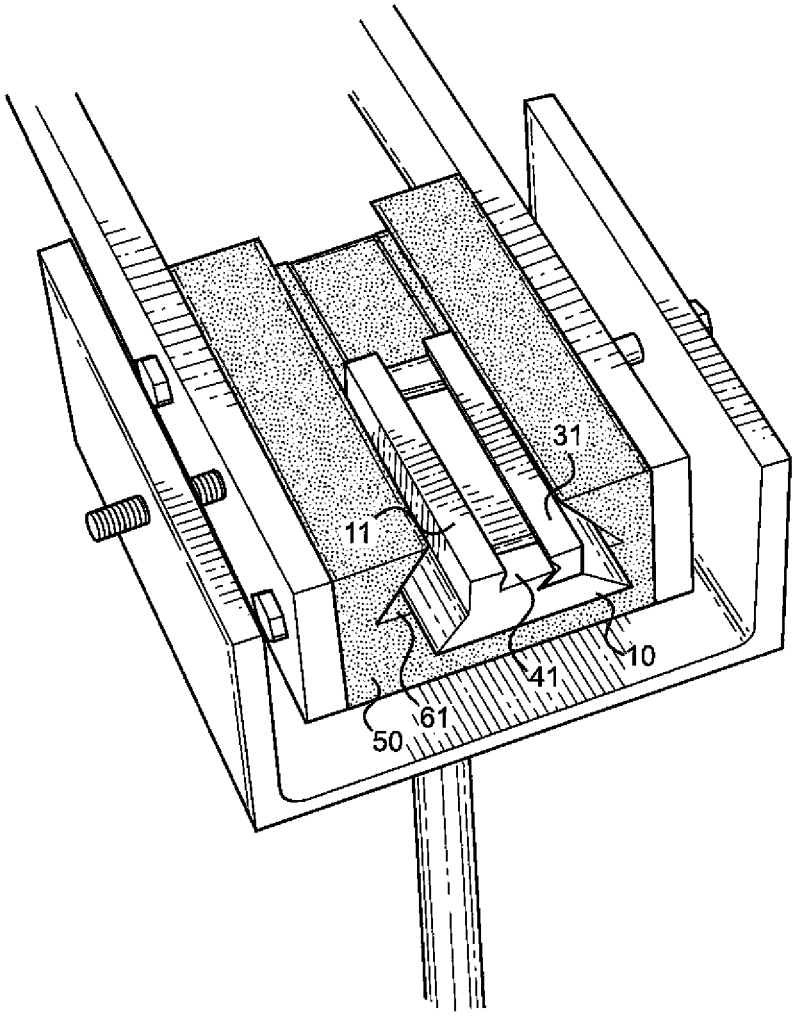
FIG. 16 depicts an overhead perspective view of a preferred embodiment of a bump stock assembly of the present invention.

FIG. 16 depicts a front perspective view of a portion of preferred embodiment of bump stock assembly of the present invention. As depicted in FIG. 16, receiving assembly 10 is received within channel 61 of supporting track member 50. Although not illustrated in FIG. 16, a hand guard of the firearm locks into channel 41 of receiving assembly 10, thereby being set into place between receiver member 11 and receiver attachment member 31. By way of illustration, but not limitation, receiver member 11 and receiver attachment member 31 can connect to a picatinny rail, or a tactical rail, of a hand guard of a firearm, or to any other similar point of connection of said hand guard. As such, receiving assembly 10 with attachably connected firearm is received within said channel 61 of supporting member 50, thereby supporting and securing said firearm to bump stock assembly.

Figure 17:
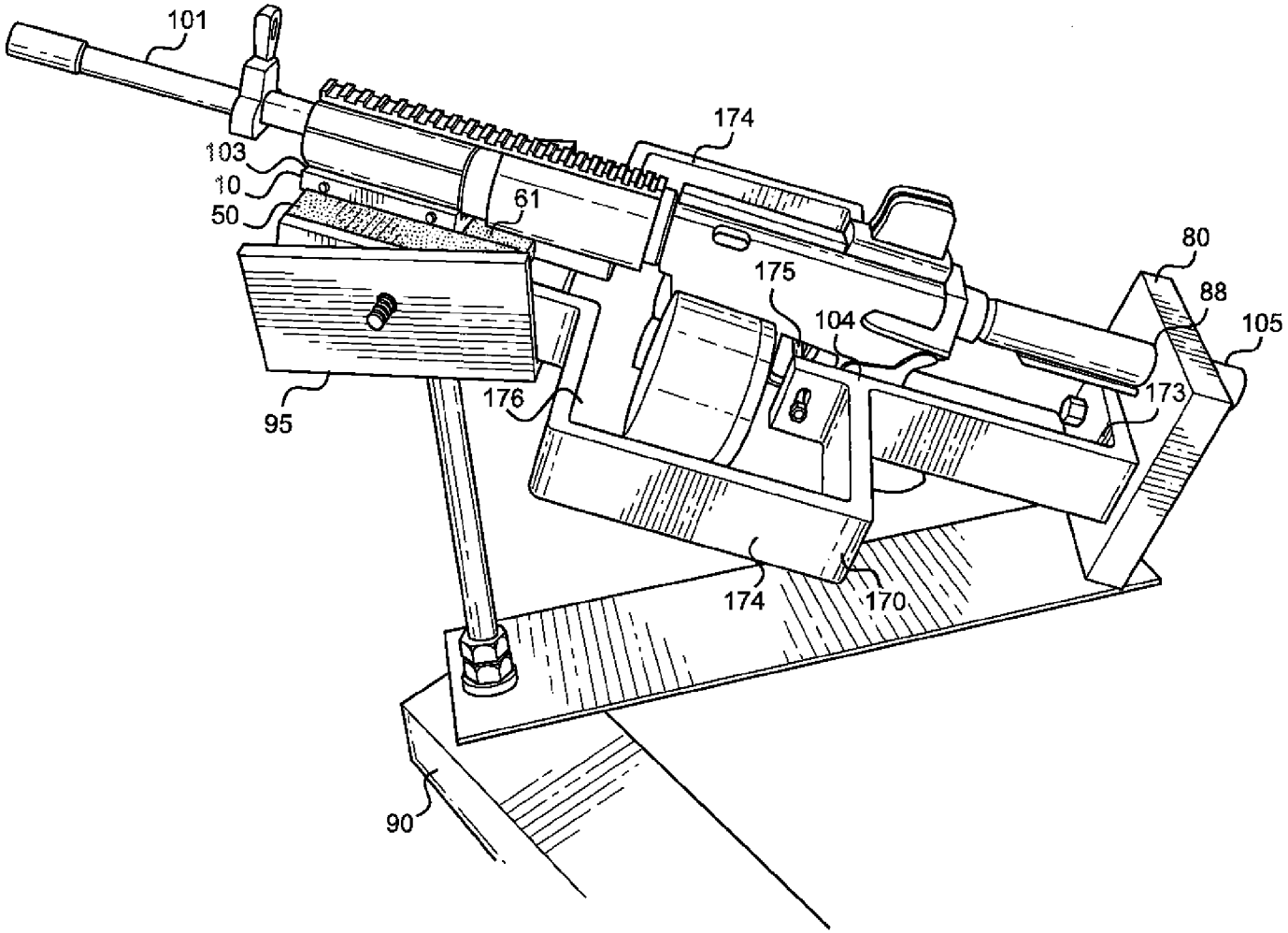
FIG. 17 depicts a side perspective view of an alternate embodiment of a bump stock assembly of the present invention with a firearm.

FIG. 17 depicts a side perspective view of an alternate embodiment of a bump stock assembly of the present invention with a mounted firearm 101 positioned therein. In said alternate embodiment, firearm 101 is placed in a center of inner opening 176 of firearm mount frame 170, with a trigger guard 104 of said firearm 101 bolted in between said sides 174 of said firearm mount frame 170 via cross-bolt 175. As illustrated in FIG. 17, sides 174 of firearm mount frame 170 allow for a variety of different types and configurations of semi-automatic firearms—including magazines and other components thereof—to fit within inner opening 176 of firearm mount frame 170.

Still referring to FIG. 17, hand guard 103 of firearm 101 is set into place by interlocking within channel 41 of receiver member 11 and receiver attachment member 31, wherein receiving assembly 10 with attachably connected firearm 101 is then slidably received within channel 61 of supporting track member 50. A buffer tube 105 of firearm 101 is then received within bore 88 of handle member 80 of the present invention, which is attached to rear end 173 of firearm mount frame 170. Additionally, firearm mount frame 170 and supporting track member 50 are then bolted to housing member 95 of stand assembly 90 of the present invention, thereby allowing firearm 101 and bump stock assembly of the present invention to be properly supported.

In operation, a user will press upon buffer tube 105 of firearm 101 with a relatively consistent forward motion. Buffer tube 105, and thus, receiving assembly 10 will move in a relatively forward direction causing receiving assembly 10 to slidably extend axially within channel 61 of supporting track member 50, thereby also causing firearm 101 to move in a relatively forward direction. As buffer tube 105, and thus, firearm 101 are pushed in a forward direction, a trigger of firearm 101 within trigger guard 104 compresses against cross-bolt 175, or any other similar rigid-like member, causing said trigger to actuate, and thus, fire said firearm 101.

Figure 18:
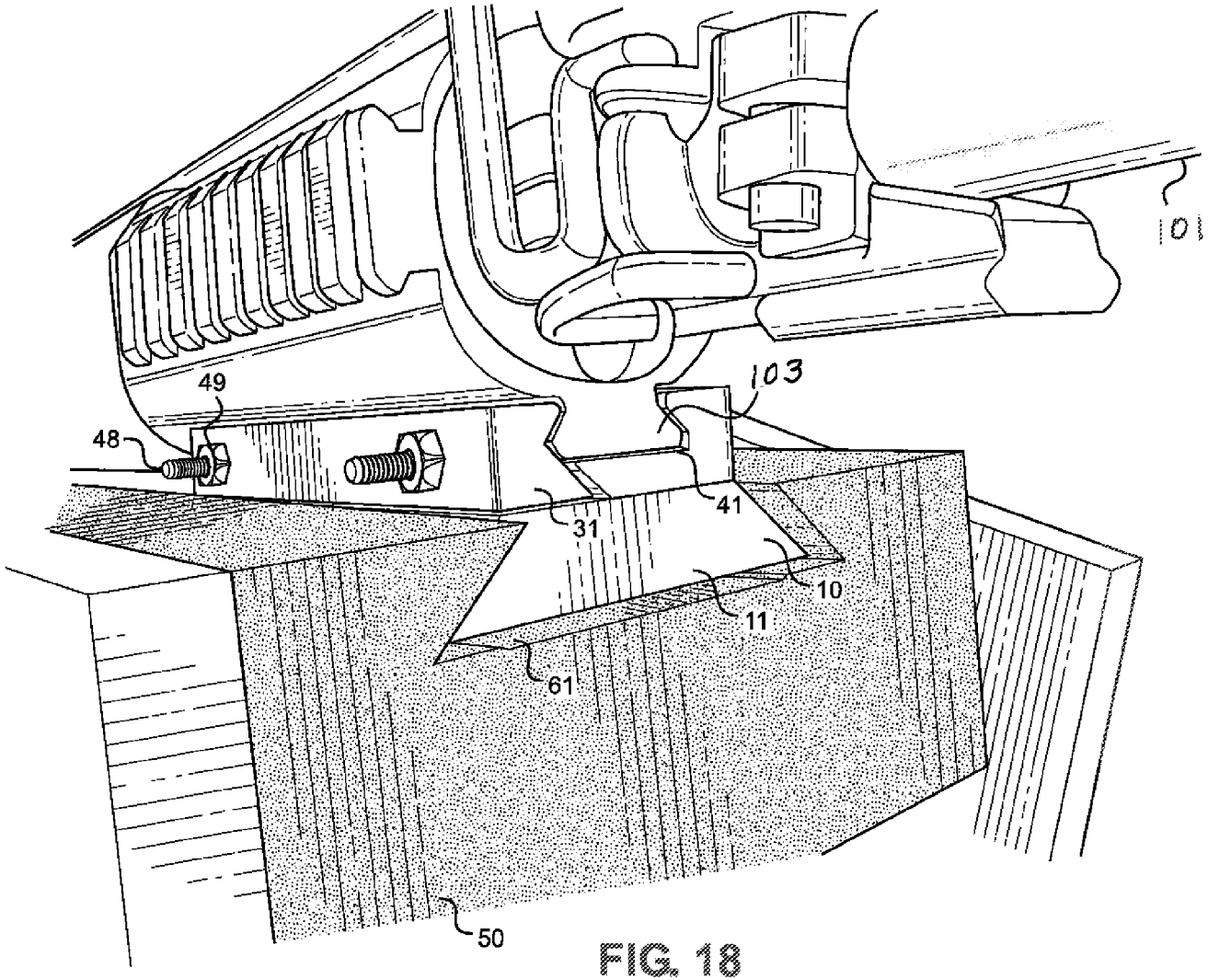
FIG. 18 depicts a front perspective view of a preferred embodiment of a supporting member and a receiving assembly of the present invention with a firearm in an interlocked position.

FIG. 18 depicts a front perspective view of a preferred embodiment of supporting track member 50 and a receiver assembly 10 with a mounted firearm 101. As depicted in FIG. 18, receiving assembly 10 is beneficially connected to a bottom of hand guard 103 of firearm 101 and is used to secure firearm 101 to bump stock assembly of the present invention. When receiving assembly is disconnected, hand guard 103 of firearm 101 is received within channel 41 of receiver member 11. Receiver attachment member 31 is then connected to receiver member 11 via bolts 48 and nuts 49, thereby attaching to hand guard 103, and thus, attachably interlocking firearm 101 to bump stock assembly. Receiving assembly 10 with attachably connected firearm 101 is then received within channel 61 of supporting track member 50.

Figure 19:
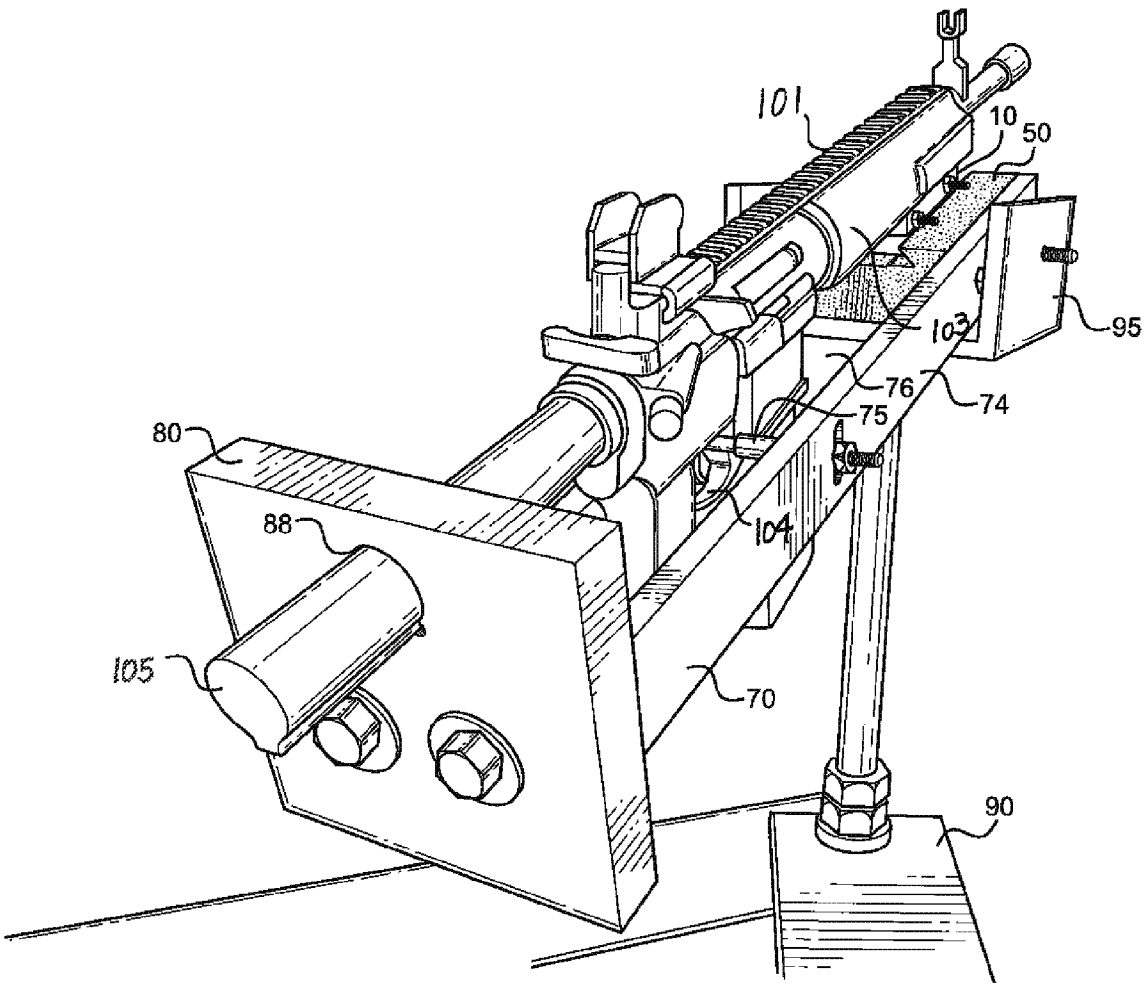
FIG. 19 depicts a rear perspective view of a preferred embodiment of a bump stock assembly of the present invention with a firearm.

FIG. 19 depicts a rear perspective view of a preferred embodiment of a bump stock assembly of the present invention with a firearm 101 mounted therein. In a preferred embodiment, firearm 101 is placed in a center of inner opening 76 of firearm mount frame 70, with a trigger guard 104 of said firearm 101 bolted in between said sides 74 of said firearm mount frame 70 via cross-bolt 75. Further, hand guard 103 of firearm 101 is set into place by interlocking within channel 41 of said receiver member 11 and said receiver attachment member 31, wherein receiving assembly 10 with attachably connected firearm 101 is then slidably received within channel 61 of supporting track member 50.

Still referring to FIG. 19, a buffer tube 105 of firearm 101 is then set into place and supported via bore 88 of handle member 80 of the present invention, which is attached to rear end 73 of firearm mount frame 70. In addition, firearm mount frame 70 and supporting track member 50 are then bolted to housing member 95 of stand assembly 90 of the present invention, thereby allowing firearm 101 and bump stock assembly of the present invention to be properly supported.

Referring to FIG. 19, in operation a user will press upon buffer tube 105 of firearm 101 with a relatively consistent forward motion. Buffer tube 105, and thus, receiving assembly 10 will move in a relatively forward direction causing receiving assembly 10 to slidably extend axially along channel 61 of supporting track member 50, thereby also causing firearm 101 to move in a relatively forward direction. As buffer tube 105, and thus, firearm 101 are pushed in a forward direction, trigger within trigger guard 104 compresses against cross-bolt 75, or any other similar rigid-like member, causing trigger to actuate, and thus, fire said firearm 101.

Following a shot, firearm 101 will recoil (or "bump") in a relatively rearward direction toward a user. When this occurs, receiving assembly 10 will slidably move or retract axially rearward along channel 61 of supporting track member 50, thereby also causing firearm 101 to move in a relatively rearward direction, thereby permitting said trigger to reset itself. Application of force in a forward direction by a user again forces said trigger against stationary cross-bolt 75 in order to depress said trigger and fire another shot in quick succession. The process is repeated, allowing semi-automatic firearm 101 to fire multiple shots in rapid succession, thereby simulating a discharge of a fully automatic firearm.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A bump stock assembly for a firearm having a pistol grip and a hand guard comprising:

a. a stand;

b. a frame pivotally mounted to said stand, said frame comprising a first side, a second side, a front and a rear, and defining an inner space for at least partially receiving said firearm including said pistol grip;

c. a track attached to said frame, wherein said track is disposed adjacent to said hand guard, defines a substantially flat surface and is oriented substantially parallel to a barrel of said firearm;

d. a receiving member operationally attached to a hand guard of said firearm, wherein said receiving member defines a substantially flat surface that is slidably disposed along said flat surface of said track; and e. a rigid member disposed at least partially through a trigger guard of said firearm.

2. The bump stock assembly of claim 1, wherein said frame pivots about a substantially vertical axis.

3. The bump stock assembly of claim 1, wherein said frame pivots about a substantially horizontal axis.

4. The bump stock assembly of claim 1, wherein said rigid member comprises a cross bolt attached to said frame.

5. The bump stock assembly of claim 1, wherein said rear member of said frame has an aperture extending through said rear member, and a buffer tube of said firearm is received in said aperture.

6. A method of simulating discharge of a fully automatic firearm using a semi-automatic firearm having a pistol grip and hand guard comprising:

a. mounting said semi-automatic firearm in a bump stock assembly, wherein said bump stock assembly comprises:

i) a stand;

ii) a frame mounted to said stand, said frame comprising a first side, a second side, a front and a rear, and defining an inner space for at least partially receiving said firearm including said pistol grip;

iii) a track attached to said frame, wherein said track is disposed beneath said hand guard, defines a substantially flat upward-facing surface and is oriented substantially parallel to a barrel of said firearm, and a hand guard of said firearm is slidably disposed along said track;

iv) a receiving member attached to a hand guard of said firearm, wherein said receiving member defines a substantially flat lower surface, is operationally attached to said hand guard and is slidably received within said track; and v) a rigid member disposed at least partially through a trigger guard of said firearm;

b. applying force to said firearm until a trigger of said firearm contacts said rigid member, causing said firearm to fire a shot;

c. permitting recoil of said firearm to move said trigger away from said rigid member; and d. applying force to said firearm until said trigger of said firearm is depressed by said rigid member, causing said firearm to fire a shot.

7. The method of claim 6, wherein said frame is pivotally attached to said stand, and said frame pivots about a substantially vertical axis.

8. The method of claim 7, wherein said frame pivots about a substantially horizontal axis.

9. The method of claim 6, wherein said rigid member comprises a cross bolt attached to said frame.

10. The method of claim 6, wherein said rear member of said frame has an aperture extending through said rear member, and a buffer tube of said firearm is received in said aperture.

* * * * *